US006367827B1

(12) United States Patent
Schneider et al.

(10) Patent No.: US 6,367,827 B1
(45) **Date of Patent: *Apr. 9, 2002**

(54) CATERPILLAR BOARD DESIGNED IN PARTICULAR FOR USE ON GRASS SLOPES

(76) Inventors: Hans jun Schneider; Rolf Schneider, both of Aebischen, CH-3202 Frauenkappelen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/480,378

(22) Filed: Jan. 10, 2000

Related U.S. Application Data

(62) Division of application No. 08/913,799, filed on Sep. 22, 1997, now Pat. No. 6,039,331.

(51) Int. Cl.[7] ..... B62M 1/00

(52) U.S. Cl. ..... 280/87.041; 180/9.5; 305/120; 305/128; 441/68

(58) Field of Search ..... 280/87.041, 28.5, 280/14.1, 28.15, 28.16, 18; 441/68, 74; 305/53, 122, 120, 128; 180/9.5, 9.34

(56) References Cited

U.S. PATENT DOCUMENTS

| | | | | |
|---|---|---|---|---|
| 613,298 A | | 11/1898 | Palmtag | 305/122 |
| 2,139,513 A | | 12/1938 | Nelson et al. | 280/18 |
| 2,309,603 A | | 1/1943 | Kohn | 305/122 |
| 4,278,302 A | * | 7/1981 | Westimayer et al. | 305/120 |
| 4,561,664 A | | 12/1985 | Cashmere | 280/18 |
| 4,572,528 A | | 2/1986 | McBride | 280/87.04 |
| 4,627,630 A | | 12/1986 | Hutter | 305/122 |
| 5,018,760 A | | 5/1991 | Remondet | 280/14.2 |
| 5,228,528 A | | 7/1993 | Sauve | 305/53 |
| 5,312,258 A | | 5/1994 | Giorgio | |
| 5,382,052 A | | 1/1995 | Tarng | |
| 5,692,579 A | * | 12/1997 | Peppel et al. | 180/190 |
| 5,752,574 A | * | 5/1998 | Oertley | 180/9.5 |
| 5,868,405 A | | 2/1999 | Lavecchia et al. | 280/14.2 |
| 5,941,326 A | * | 8/1999 | Fleuchaus | 180/9.1 |
| 6,039,331 A | * | 3/2000 | Schneider et al. | 280/14.2 |

FOREIGN PATENT DOCUMENTS

| | | | |
|---|---|---|---|
| AU | 3280878 | 8/1979 | |
| CA | 2023 228 | 1/1992 | 280/14.2 |
| FR | 2187369 | 1/1974 | |
| FR | 306 697 A | 3/1989 | 441/74 |
| IT | 973007 | 1/1972 | |
| WO | 90/00998 | 2/1990 | |
| ZA | 730392 | 1/1973 | |

* cited by examiner

*Primary Examiner*—Kenneth R. Rice
*Assistant Examiner*—Lynda Jasmin
(74) *Attorney, Agent, or Firm*—Sidley Austin Brown & Wood, LLP

(57) ABSTRACT

The proposed crawler-mounted board (1) is specifically for the purpose of riding over grass or lawn slopes. It features a crawler unit which consists of two slightly concave-curved undercarriage tracks (12), the tracks being connected to one another by four cross-struts (13). The crawler unit can be mounted to a frame (2) made of tubing or rods. Each of the undercarriage tracks (12) consists of a long elongated body, a flexible crawler track chain, and large number of crawler track segments. A block can be mounted to the outside of each crawler track segment. While the crawler-mounted board is in motion, frictional forces act between the turf and the crawler track chains and the blocks of the crawler unit. These frictional forces cause the crawler track chains along with the crawler track segments to move around the body of the undercarriage tracks (12) in a closed circuit.

18 Claims, 7 Drawing Sheets

CATERPILLAR BOARD DESIGNED IN PARTICULAR FOR USE ON GRASS SLOPES

This application is a divisional of application Ser. No. 08/913,799, filed Sep. 22, 1997, now U.S. Pat. No. 6,039, 331.

BACKGROUND OF THE INVENTION

The invention pertains to a crawler-mounted board.

Snowboarding has developed into a popular, widely practiced sport for which competitions are also staged. For professional snowboarders it is important that they be able to train regularly. Regular training is indispensable for performing well in competitions. Snowboarders are forced to discontinue training in winters in which little snow falls or in summer. Regular training is rendered altogether impossible in areas with little snowfall.

According to the current state of the art, grass skis are known which are suitable for use on snowless substrates, however there has been no sports equipment to date which could be used in lieu of snowboards. Grass skis are described in Italian printed patent specification 97 3007, for example.

Consequently, the purpose of the invention is to create a board serving as sports equipment which is particularly suitable for riding over the grass of a meadow.

SUMMARY OF THE INVENTION

According to one embodiment of the invention, the proposed crawler-mounted board possesses a load-bearing structure in the form of a frame made of tubing or rods which is subdivided into an essentially rectangular-shaped main part and a bow-shaped front part. The main part of the frame is reinforced by struts. It also supports devices for mounting the bindings. A crawler unit (track-type undercarriage) is mounted to the underside of the frame. This crawler unit consists of two slightly curved longitudinal undercarriage tracks which a reconnected to one another by cross-struts. Each of the undercarriage tracks consists of a circuiting profile strip, several crawler track segments, and a flexible crawler track chain made of rubber or plastic.

BRIEF DESCRIPTION OF THE DRAWINGS

The invention is illustrated as follows by an embodiment in the drawings, among other things. The drawings depict the following.

DETAILED DESCRIPTION OF THE INVENTION

Figure 1A:
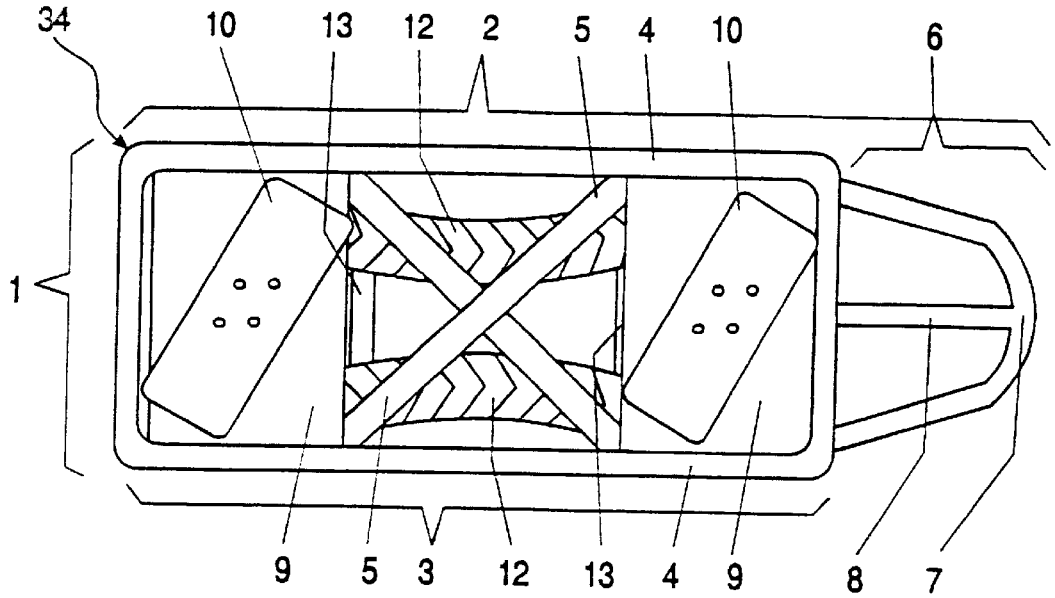
FIG. 1*a* View from above of the proposed crawler-mounted board.

The proposed crawler-mounted board (1) is particularly suitable for riding over grass or lawn slopes.

The first embodiment of the proposed crawler-mounted board (1) features a load-bearing structure (34) in the form of a frame (2) which is made of round tubing or round rods. The main part (3) of the frame (2) is essentially rectangular in shape (cf. FIG. 1*a* and FIG. 1*b*). The corners of the main part (3) are preferably beveled or rounded to reduce the risk of injury. The two lengthwise sides (4) of the main part (3) are connected to one another by two struts (5). The two struts (5) extend to the lengthwise sides (4), forming a sharp angle where they meet the lengthwise sides (4), and cross at the middle lengthwise axis of the frame (2).

Figure 1B:
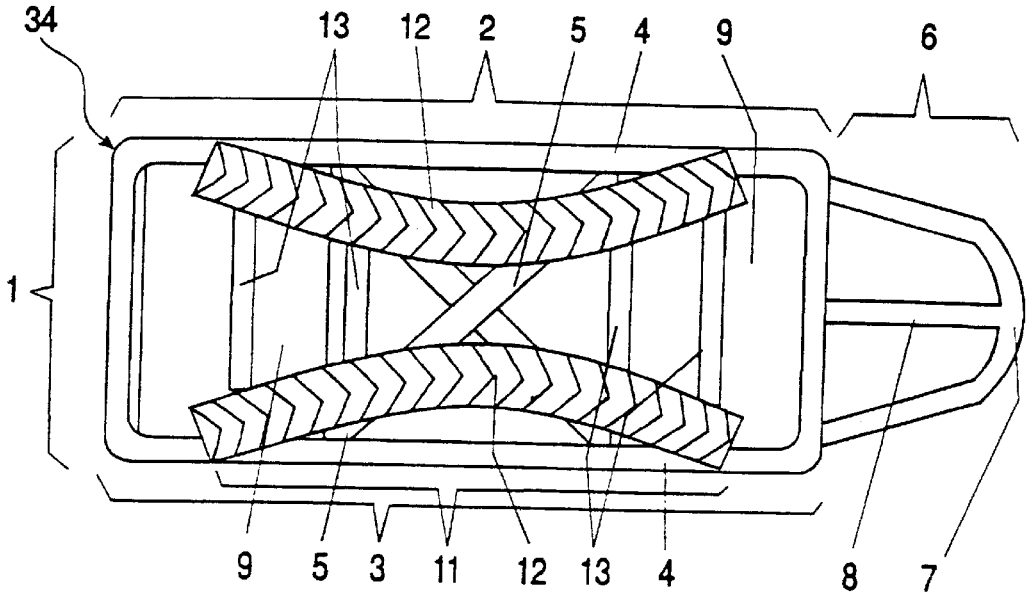
FIG. 1*b* View from below of the crawler-mounted board in accordance with FIG. 1*a;*

A bow-shaped front part (6) adjoins one of the ends of the frame main part (3) (cf. FIGS. 1*a* and 1*b*). In the embodiment shown, this front part (6) approximates the form of an isosceles trapezoid, with its base bordering on the frame main part (3). The transverse section (7) located at the frontmost position of the frame front part (6) is preferably curved. In addition, the front part (6) features a lengthwise strut (8) which is located between the front end (6) of the frame main part (3) and the transverse section (7) of the frame front part (6).

Two rectangular-shaped transverse plates (9) are mounted to the main part (3) of the frame (2). The two transverse plates (9) are located at the rear and front end sections of the frame main part (3). Each of the transverse plates (9) features a rectangular-shaped foot plate (10) on its upper side (cf. FIG. 1*a*). The middle lengthwise axis of each foot plate (10) intersects with the middle lengthwise axis of the respective transverse plate (9) at an angle.

Figure 4:
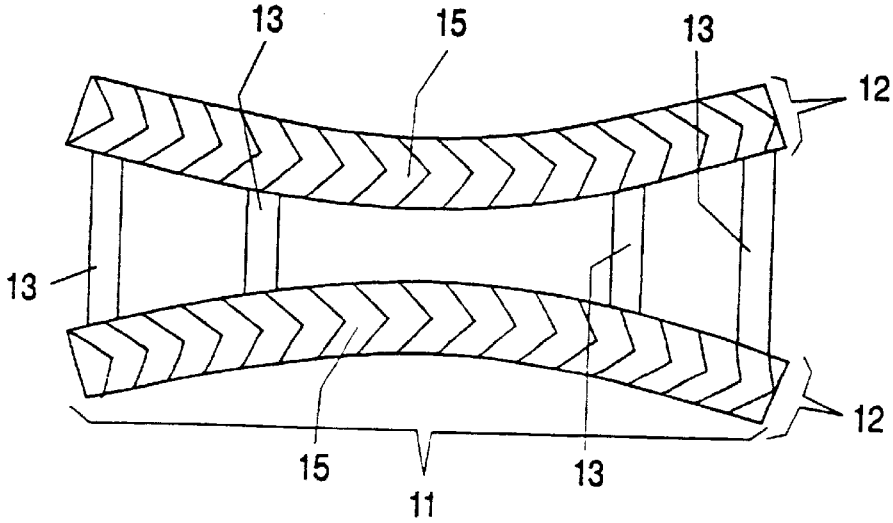
FIG. 4 A view from above of the crawler unit of the crawler-mounted board according to FIG. 1*b;*

A crawler unit (11) is mounted on the underside of the frame main part (3) and the transverse plates (9) (cf. FIG. 1*b*). This crawler unit (11) consists of two lengthwise undercarriage tracks (12) which are connected to one another by four cross-struts (13) (cf. FIG. 4). The two undercarriage tracks (12) are adjacent to one another, their being aligned parallel to one another and located opposite of one another in laterally reversed fashion. In addition, they are slightly curved towards one another, in other words they are concave. Consequently, the width of the crawler-mounted board (1) is narrowest mid-way between its two ends. As a consequence it could also be stated that it has a "waist".

Each undercarriage track (12) consists of a circuiting profile strip (14). Each of the circuiting strips (14) features two straight, parallel middle sections and two curved end sections (cf. FIG. 2). The middle sections are spaced close to each other or make contact with one another. The profile strips (14) have a rectangular cross section. They possess a continuous base plate (17) and two continuous side walls (18) (cf. FIG. 3). Their cover plate (19) features a lengthwise slit (20) which extends along the middle lengthwise axis of the cover plate (19).

Figure 2:
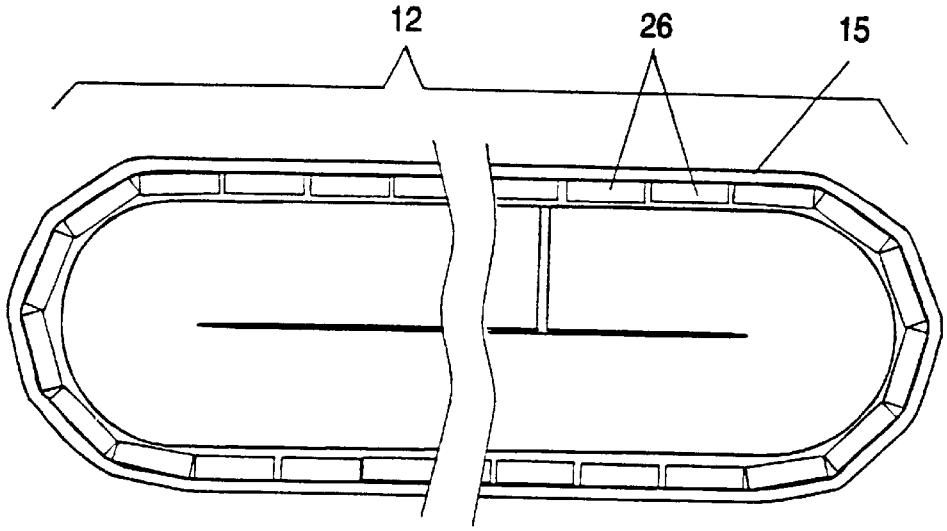
FIG. 2 View from the side of one of the undercarriage tracks of the crawler-mounted board according to FIG. 1*b;*
Figure 3:
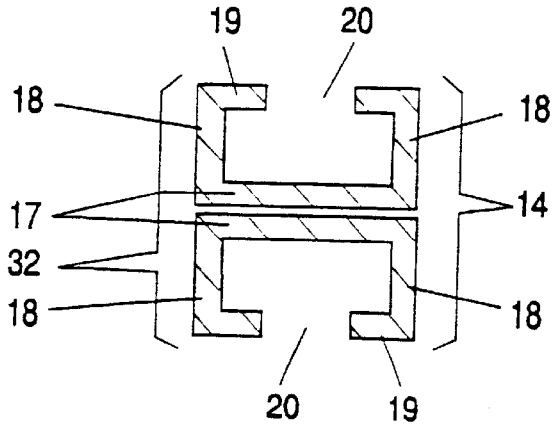
FIG. 3 A cross-sectional view through the circuiting profile strip of one of the undercarriage tracks according to FIG. 2.

The undercarriage tracks (12) can be made of a straight profile strip (14) which is bent into the form desired (cf. FIG. 2). When the profile strip (14) is curved, its two ends are located next to one another. It is not absolutely necessary to close the gap between the two ends.

Figure 5:
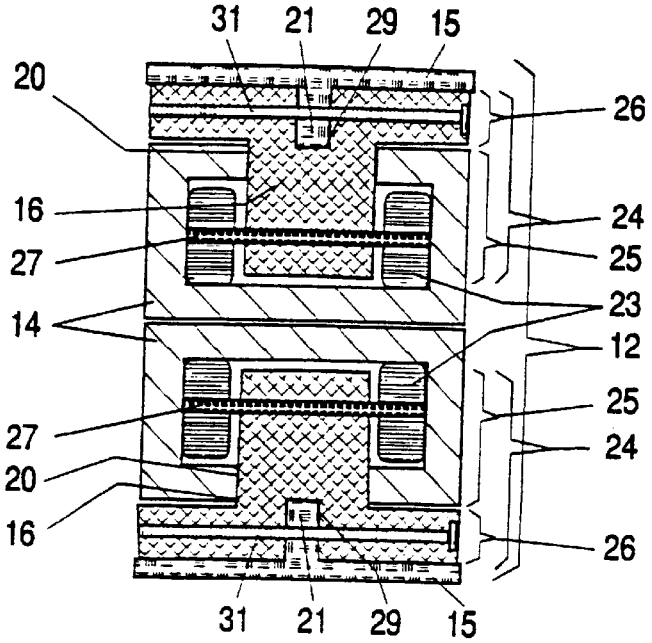
FIG. 5 A cross-sectional view through one of the undercarriage tracks according to FIG. 4.
Figure 6A:
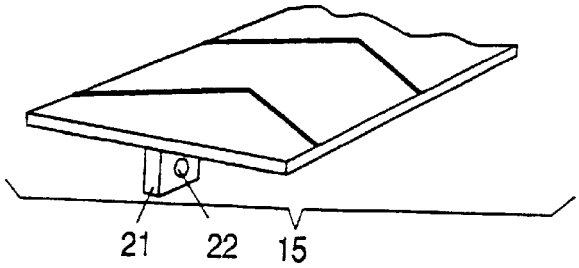
FIG. 6*a* A perspective rendering of a portion of the crawler track chain of one of the undercarriage tracks according to FIG. 4.
Figure 6B:
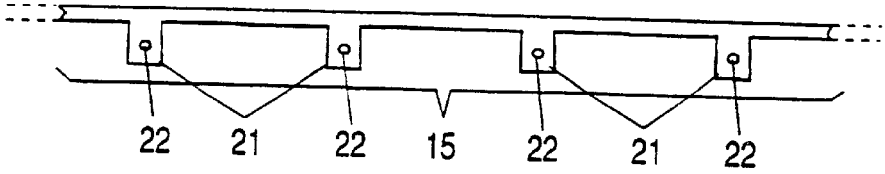
FIG. 6*b* A view from the side of a portion of the crawler track chain according to FIG. 6*a;*

Outside of each of the profile strips (14) is a circuiting, flexible crawler track chain (15) (cf. FIG. 2 and FIG. 5). This crawler track chain (15) is somewhat wider than the undercarriage track (12). It is preferably made of nylon or hard rubber and features a profile section along its outer side. In addition, its inner side bears a large number of mounting plates (21) with a rectangular cross section. These mounting plates (21) project at a right angle from the crawler track chain (15). They are spaced evenly along the middle lengthwise axis of the crawler track chain (15). Each of the mounting plates (21) features a transverse, continuous round hole (22) (cf. FIG. 6*a* and FIG. 6*b*). The crawler track chain (15) is mounted to a large number of crawler track segments (16). These crawler track segments (16) run on rollers (23) along the respective undercarriage track (12).

Figure 7:
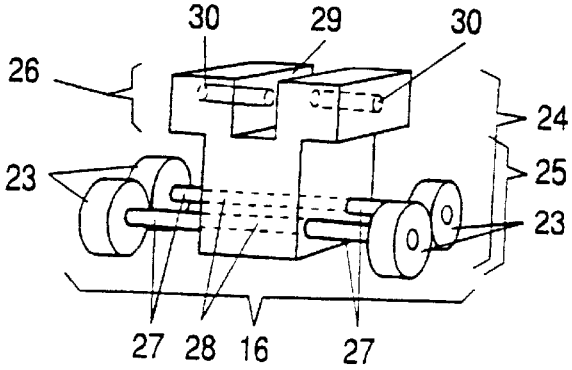
FIG. 7 A perspective rendering of a crawler track segment of one of the undercarriage tracks according to FIG. 2.

Each of the crawler track segments (16) consists of a solid body (24), two continuous, fixed axles (27), and four rollers (23) (cf. FIG. 7). The body (24) is subdivided into a wide, rectangular-parallelepiped-shaped outer section (26) and a narrow, also rectangular-parallelepiped-shaped inner section (25).

The inner section (25) is as equally wide as or slightly narrower than the lengthwise slit (20) of the cover plate (19). Its height is greater than the height of the undercarriage track chamber by the thickness of the cover plate (19). The inner section (25) features two transverse holes (28), each of them accommodating a roller axle (27). The length of the roller axles (27) is slightly smaller than the width of the undercarriage track chamber. Each roller axle (27) carries a roller (23) at either of its end sections. The rollers (23) are rotatably mounted to the fixed roller axles (27). They project along the inner side of the inner section (25). The inner section (25) consequently projects slightly at the outer side of the profile strip cover plate (19) so that a small space is created between the outer section (26) and the cover plate (19) (cf. FIG. 5).

The outer section (26) of a crawler track segment (16) serves to mount the crawler track chain (15). It preferably has the same width or is slightly wider than the profile strip (14). In addition, it is at least half as high as the inner section (25).

The outer section (26) also features a recess (29) for mounting the crawler track chain (15), the recess (29) being open towards the outside of the outer section (26). In addition, the outer section (26) also features a continuous transverse threaded hole (30). Each recess (29) accommodates a mounting plate (21) of the crawler track chain (15). A screw (31) is screwed into the threaded hole (30) of the outer crawler track segment section (26) to affix the mounting plate (21) in the recess (29), the screw (31) being inserted through the hole (22) in the mounting plate (21) (cf. FIG. 5). The crawler track chain (15) rests on the outside of the outer section (26).

The length of the crawler track segments (16) is preferably smaller than their height so that it can be ensured that the crawler track segments (16) do not jam in the curved sections of the profile strip (14).

The second embodiment of the proposed crawler-mounted board (1) does not feature a frame. The load-bearing structure (34) of the crawler-mounted board (1) is formed by the bodies (32) of the two undercarriage tracks (12), four cross-struts (13), the cross-struts (13) connecting the two bodies (32) to one another, and a hoop (33) (cf. FIG. 8 and FIG. 9).

Figure 11:
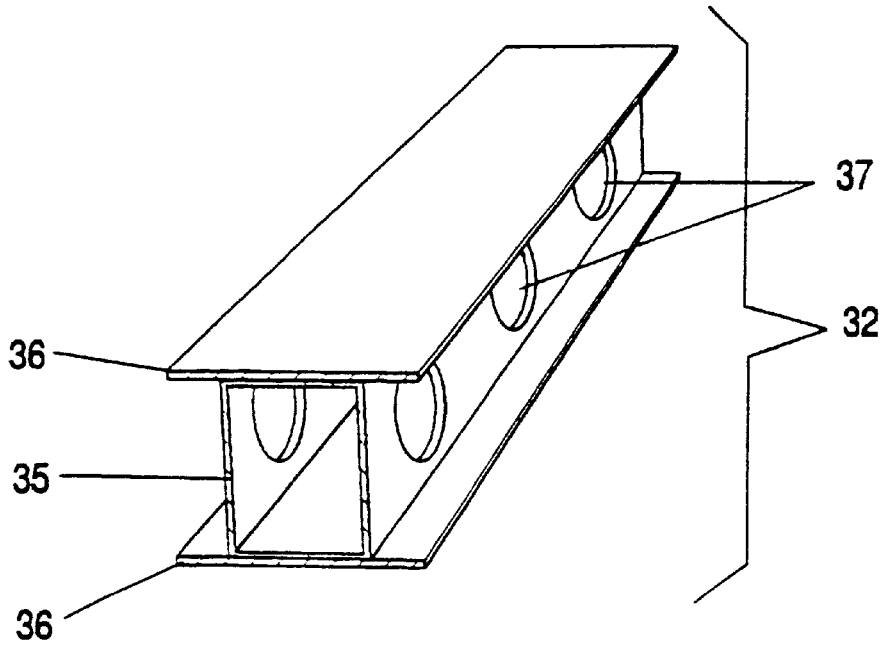
FIG. 11 A perspective rendering of the body of an undercarriage track according to FIG. 10.

Each body (32) of an undercarriage track (12) consists of a square hollow section strip (35), which bears a circuiting plate (36) (cf. FIG. 11). The underside of the square hollow section strip (35) is preferably slightly convex. The square hollow section strips (35) can feature round holes in their side walls for the purpose of reducing the weight of the undercarriage tracks (12). The circuiting plate (36) features a long, straight section, two short, sharply curved sections and a long, slightly curved section. The long, straight section is located on the upper side of the square hollow section strip (35) and extends along its entire length. The long, slightly curved section is located on the underside of the square hollow section strip (35). It, too, extends along the entire length of the square hollow section strip (35). The two short, sharply curved sections are located at either end of the square hollow section strip (35). They connect the two long sections with one another.

Figure 8:
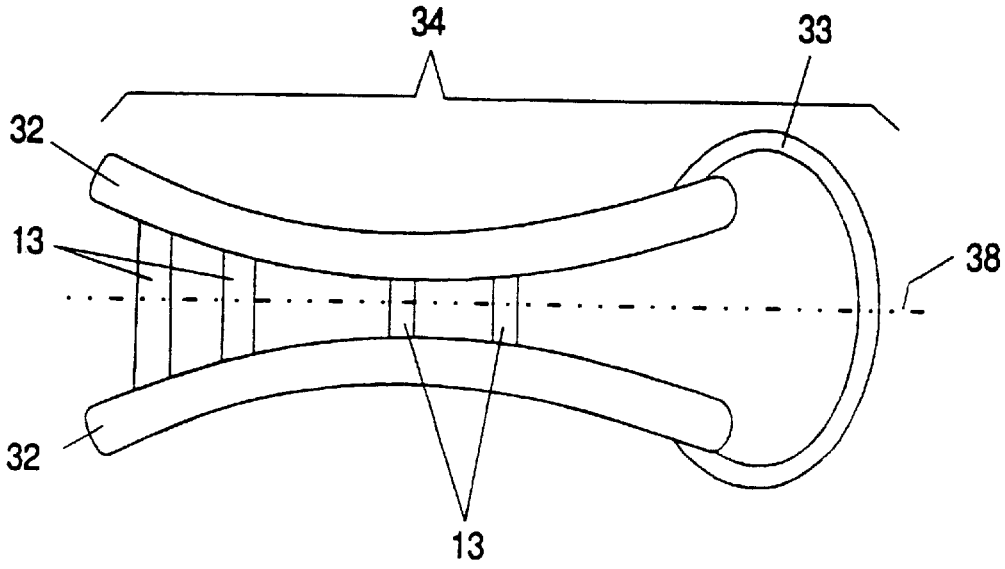
FIG. 8 A view from above of the load-bearing structure of a proposed crawler-mounted board of the second embodiment.
Figure 9:
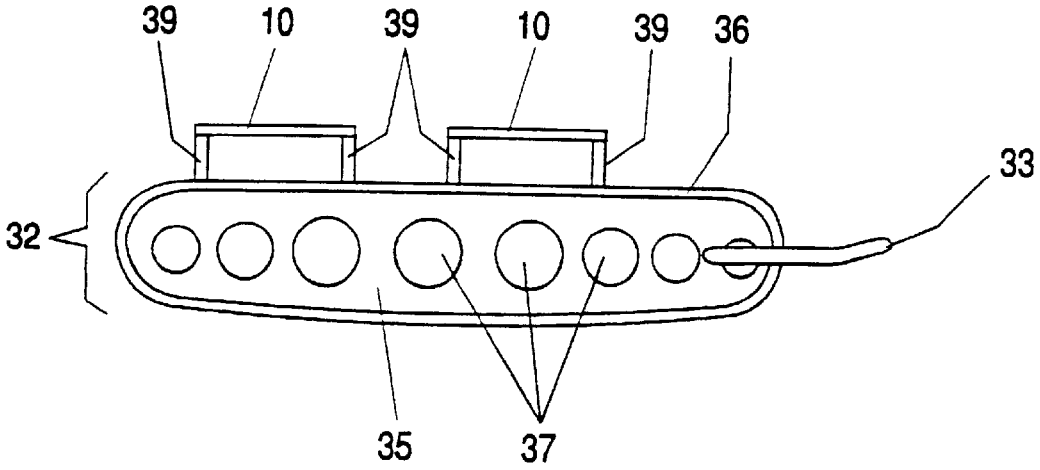
FIG. 9 A view from the side of the load-bearing structure according to FIG. 8 with the devices mounted for securing the bindings.

The two bodies (32) of the undercarriage tracks (12) are connected to one another by four cross-struts (cf. FIG. 8). These cross-struts (13) are mounted to the inner side of the square hollow section strips (35). They are positioned at a right angle to the middle lengthwise axis (38) of the load-bearing structure (34). In addition, the cross-struts (13) are arranged in pairs. One strut pair is located approximately mid-way, the other strut pair in the rear quarter section of the undercarriage tracks (12). The two undercarriage tracks (12) are located adjacent to one another, their being aligned parallel to one another and located opposite of one another in laterally reversed fashion. In addition, they are slightly curved towards one another, in other words they are concave. Consequently, the load-bearing structure (34) of the crawler unit (11) is narrowest mid-way between its two ends. As a consequence it could also be stated that the crawler unit (11) has a "waist".

The hoop (33), which serves to absorb impacts as well as is used as a carrying handle for the crawler-mounted board (1), is located at the front end of the load-bearing structure (34). Each of the hoop ends is mounted to the outer side surface of an undercarriage track (12). The mounting sites are preferably located on the square hollow section strips (35) of the undercarriage tracks (12).

Figure 14:
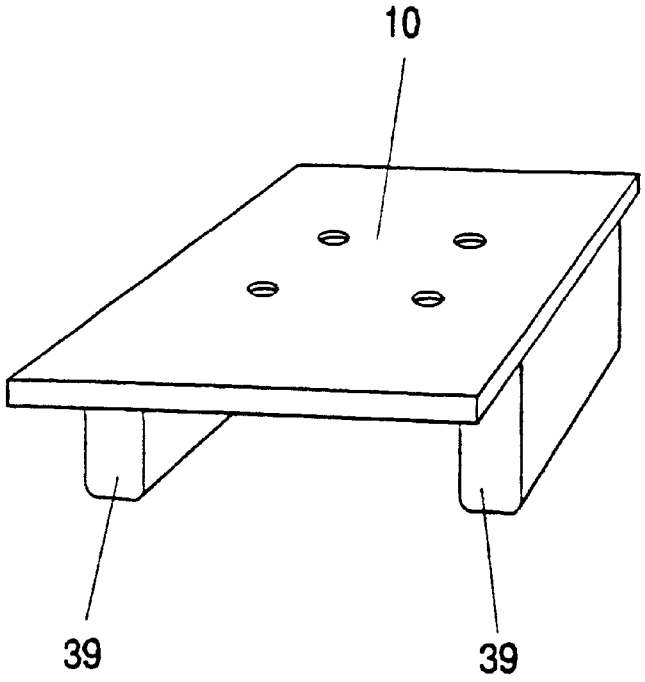
FIG. 14 A perspective rendering of a device for securing a binding according to FIG. 9.

On each of the cross-strut pairs is a device for securing a binding. Such a device consists of a rectangular-shaped foot plate (10) on whose upper side plate-like supports (39) project at a right angle (cf. FIG. 9 and FIG. 14). Each of the two supports (39) of a securing device extend along a lengthwise edge of the foot plate (10). Each of them is secured by their lower narrow side to a cross-strut (13) of a strut pair. In addition, they are positioned parallel to the cross-struts (13). They are somewhat shorter than the cross-struts (13) so that they do not obstruct the crawler track segments (16). The length of the foot plate (10) is at least the same as the width of the load-bearing structure (34) in the area of the respective cross-strut pair. The height of the supports (39) has been selected so that they tower above the crawler track segments (16), which are located on the upper side of the undercarriage tracks (12). This ensures that the foot plate (10), which projects to either side of the supports (39), does not obstruct the crawler segment tracks (16).

The crawler of an undercarriage track (12) consists of a large number of crawler track segments (16) which are connected to one another by a circuiting, flexible crawler track chain (15). This crawler track chain (15) has approximately the same width as the undercarriage track (12). It is preferably made of nylon or rubber. The crawler track segments (16) run on rollers (23) along the circuiting plate (36) of the body (32) of an undercarriage track (12) (cf. FIG. 10).

Figure 10:
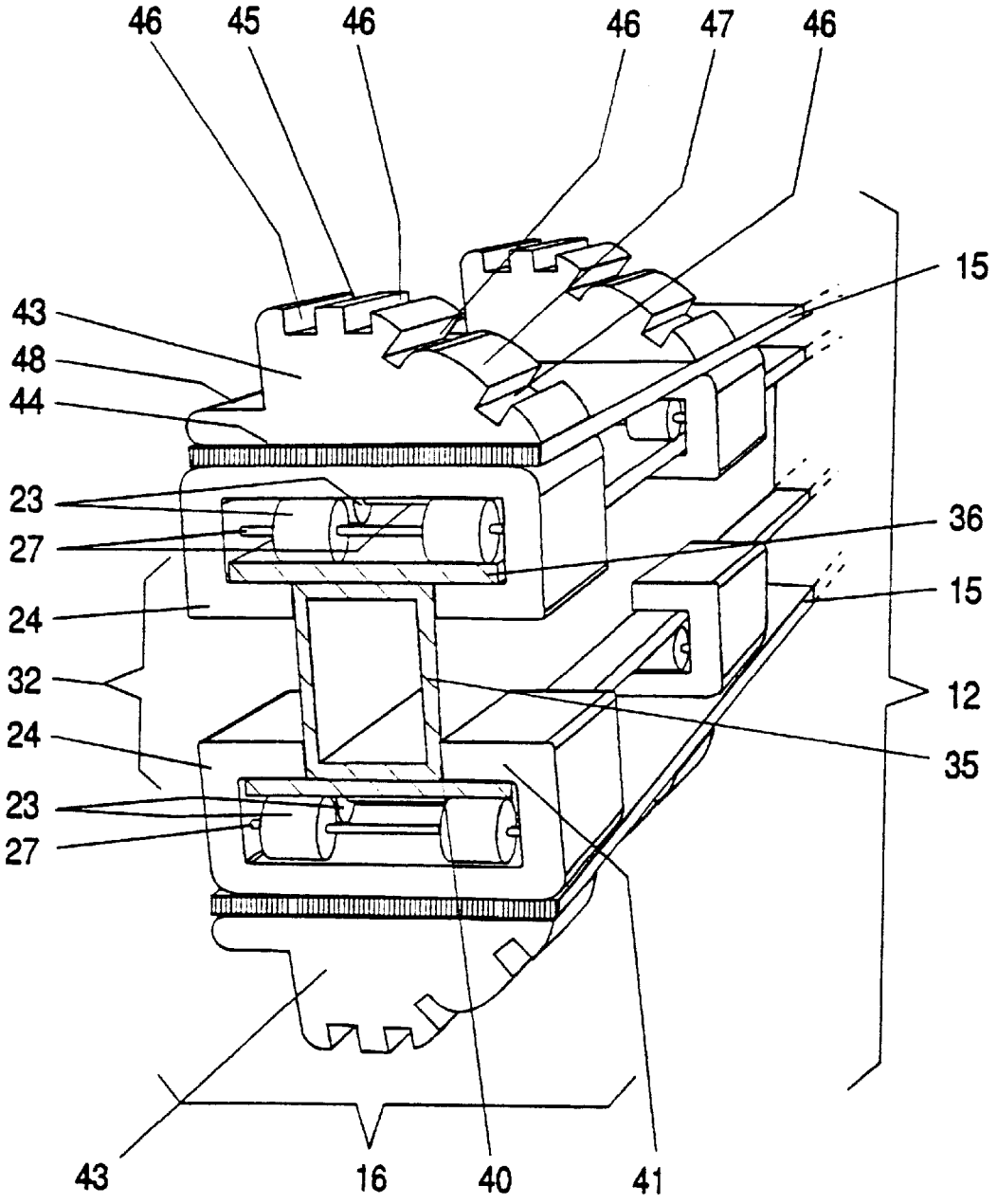
FIG. 10 A perspective rendering of a section of an undercarriage track of, a crawler-mounted board of the second embodiment.
Figure 12:
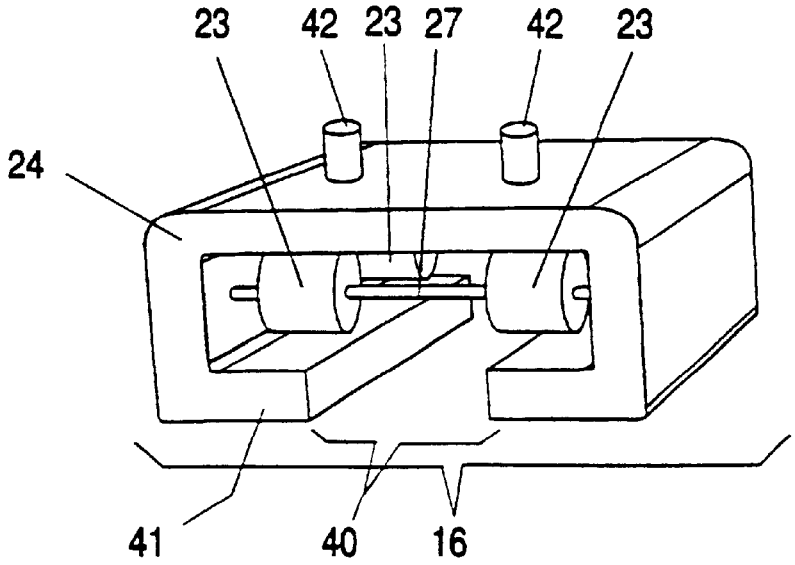
FIG. 12 A perspective rendering of a crawler track segment of an undercarriage track according to FIG. 10.

Each crawler track segment (16) comprises a body (24) (cf. FIG. 10 and FIG. 12). This body (24) consists of a short piece of a square hollow section strip. It features a continuous slit (40) on its inner wall (41). Its end sides are open. On the inside of each body (24) are four rollers (23). These four rollers (23) are mounted to common axles (27) which are positioned transversely to the slit (40).

The body (24) of each crawler track segment (16) accommodates the circuiting plate (36) of the undercarriage track body (32) (cf. FIG. 10). The circuiting plate (36) penetrates the interior of the crawler track segment body (24) in the area between the rollers (23) and the inner body wall (41). The rollers (23) of each crawler track segment (16) rest on the outside of the circuiting plate (36) of the undercarriage track body (32). The square hollow section strip (35) of the undercarriage track body (32) projects through the slit (40) on the inner wall (41) of the crawler track segment body (24) into the interior of the crawler track segment body (24).

Two cylindrical studs (42) project from the outside of the outer wall of the crawler track segment body (24). These studs (42) are used for mounting the crawler track chain (15) and a block (15). The crawler track chain (15) connects the crawler track segments (16) to one another. The blocks (43) increase the frictional forces between the crawler track segments (16) and the ground. The crawler track chain (15) features two round holes per crawler track segment (16) through which the studs (42) are inserted.

Figure 13:
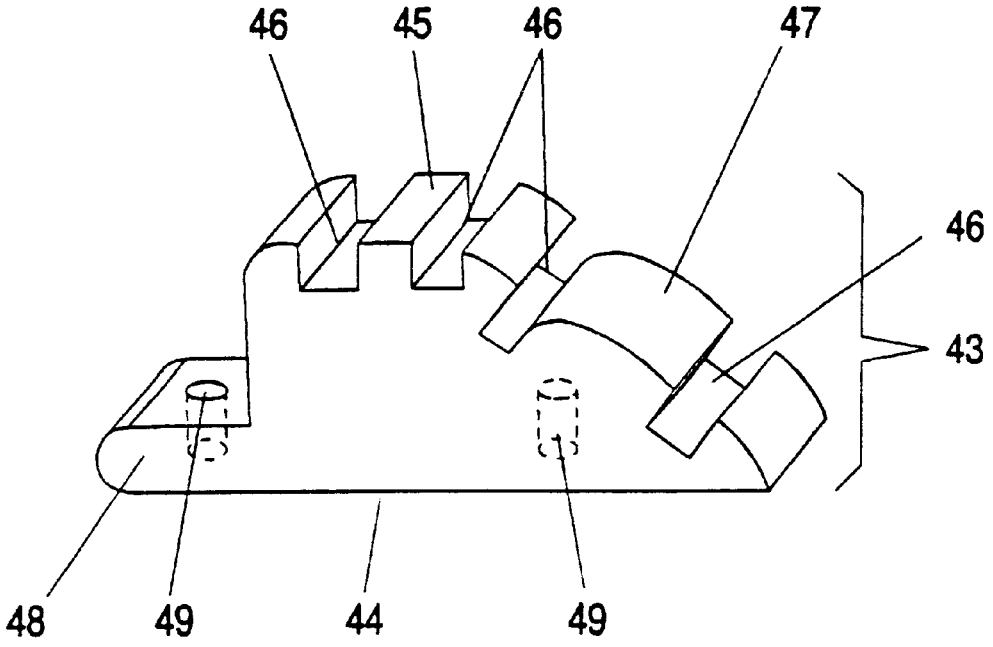
FIG. 13 A perspective rendering of a block of an undercarriage track according to FIG. 10.

The blocks (43) are essentially prism-shaped (cf. FIG. 10 and FIG. 13). The front and back of each block (43) are smooth and are positioned parallel to one another. The inside (44) and the outside (45) of each block (43) are also positioned parallel to one another. They are positioned at a right angle to the front and back. Whereas the inside (44) is smooth, the outside (45) features at least two transverse grooves (46). One of the side surfaces of each block is smooth and is positioned at a right angle to both the front and the back as well as to the inside and outside. The other side surface (47) is positioned at an angle to the inside and outside. It also features at least two transverse grooves (46). A plate-like tongue (48) projects from the smooth side surface, the inside of the tongue being flush with the inside (44) of the block (43).

The inside (44) of each block (43) features two cylindrical holes (49) which have the same diameter and the same spacing as the studs (42) on the outer wall of the crawler track segment body (24). A block (43) is secured to each crawler track segment body (24) by being mounted onto the studs (42) projecting from the outside wall of the body (24). When a block (43) is mounted the holes (49) on the inside (44) accommodate the studs (42) of the body (24). The studs (42) can be locked in place in the holes (49) by using a snap connection. Fixing the studs (42) in place can also be done using a splint which extends all the way through the block (43) and through the inserted stud (42). The crawler track chain (15) is clamped between the body (24) and the block (43) of a crawler track segment (16). Each of the chamfered edges of the block (43) faces the outer side wall of either of the undercarriage tracks (12).

The proposed crawler-mounted board (1) is suitable for use on grass and lawn slopes. It functions as follows:

First the crawler-mounted board (1) is set on the turf of a slope with the crawler unit (11) facing downwards. Then it is fastened to both of the shoes of the athlete using the bindings. While the crawler-mounted board is in motion, frictional forces act between the turf and the crawler track chains (43) and the blocks (43) of the crawler unit (11). These frictional forces cause the crawler track chains (15) along with the crawler track segments (16) to move around the body (32) of the undercarriage tracks (12) in a closed circuit. In the second embodiment of the proposed snowboard, the blocks (43) reduce the lateral slipping of the undercarriage tracks (12) on the turf. The chamfered edges of the blocks (43) enable the individual riding the crawler-mounted board to maneuver the crawler-mounted board (1) at an angle to the turf, thus enabling curves to be taken more easily.

The proposed crawler-mounted board (1) offers a snowboarder the possibility for the first time of practicing even when no snow is present. This is of particular importance to professional snowboarders, who are afforded the possibility, for example, of training for slalom events also in summer. As a consequence, training and good condition can also be maintained during times of the year when there is no snow.

What is claimed is:

1. Apparatus adapted particularly for the purpose of riding over grass or lawn slopes, said apparatus comprising:

a load-bearing structure formed at least in part from tubing or rods and comprising mounting bindings; and a crawler unit connected to said load-bearing structure, said crawler unit comprising at least two lengthwise tracks, said tracks being slightly concave-curved towards each other.

2. Apparatus according to claim 1, said load-bearing structure being a frame to which said tracks are mounted, each of said tracks comprising a profile strip, crawler track segments connected to one another and being capable of being slid lengthwise along the profile strip, and a crawler track chain, said crawler track chain being mounted to each of said crawler track segments.

3. Apparatus according to claim 2, said profile strip comprising middle sections separated by a narrow space, end sections, and cover plates, said cover plates adjoining said end sections and each defining a lengthwise slit.

4. Apparatus according to claim 3, the inner section of each crawler track segment projecting outside of the profile strip cover plate and defining a space between the outer body section of each crawler track segment and the cover plate of the profile strip when the crawler unit is assembled.

5. Apparatus according to claim 2, each of said crawler track segments comprising a body subdivided into an outer section and a narrower inner section, and comprising rollers affixed to said body in a rotatable fashion.

6. Apparatus according to claim 5, said inner section of the body and the rollers of each crawler track segment being located inside the profile strip, and the outer body section of each crawler track segment being located outside of the profile strip.

7. Apparatus according to claim 5, the outer section of each crawler track segment featuring a recess for accommodating a mounting plate of the crawler track chain, said mounting plate defining a hole, said outer section of each crawler track segment defining a threaded hole configured to engage a screw for affixing the mounting plate to the crawler track segment, said screw being capable of being inserted through the hole in the mounting plate.

8. Apparatus according to claim 2, the length of the crawler track segments being smaller than their height.

9. An apparatus adapted particularly for the purpose of riding over grass or lawn slopes to simulate snowboarding, said apparatus comprising:

a crawler unit assembly comprising lengthwise crawler tracks configured to contact grass or lawn slopes, said crawler tracks of said crawler unit assembly being concave-curved towards each other; and a frame connected to said crawler unit assembly, said frame comprising mounting bindings, and said frame being configured to support a user of said apparatus.

10. The apparatus of claim 9, each of said crawler tracks of said crawler unit assembly comprising a track guide and a track chain mounted for movement along said track guide, said track chain being configured to contact grass or lawn slopes.

11. The apparatus of claim 10, said track guide of each of said crawler tracks comprising a circuiting profile strip.

12. The apparatus of claim 10, said track chain of said crawler tracks comprising a material selected from the group consisting of nylon and rubber.

13. The apparatus of claim 10, each of said crawler tracks comprising a crawler track segment connected to said track chain and mounted for movement along said track guide.

14. The apparatus of claim 9, said frame comprising a tube or a rod.

15. The apparatus of claim 9, said frame comprising a strut extending across the width of said frame.

16. The apparatus of claim 9, said frame comprising a strut oriented along the length of said frame.

17. The apparatus of claim 9, said frame comprising at least one foot plate.

18. The apparatus of claim 9, said frame having a bow-shaped portion toward a front of said frame.

* * * * *